US006571523B2

(12) United States Patent
Chambers

(10) Patent No.: US 6,571,523 B2
(45) Date of Patent: Jun. 3, 2003

(54) WALL FRAMING SYSTEM

(76) Inventor: Brian Wayne Chambers, 102 Timberhill Dr., Hendersonville, TN (US) 37075

( * ) Notice: Subject to any disclaimer, the term of this patent is extended or adjusted under 35 U.S.C. 154(b) by 0 days.

(21) Appl. No.: 09/855,562

(22) Filed: May 16, 2001

(65) Prior Publication Data

US 2002/0170250 A1 Nov. 21, 2002

(51) Int. Cl.[7] ..... E04C 1/00; E04C 2/34; E04B 1/00

(52) U.S. Cl. ..... 52/309.2; 52/309.7; 52/309.8; 52/794.1; 52/270

(58) Field of Search ..... 52/309.2, 309.7, 52/309.8, 309.9, 586.1, 794.1, 742.13, 270, 271, 284

(56) References Cited

U.S. PATENT DOCUMENTS

| | | | | | |
|---|---|---|---|---|---|
| 3,159,882 | A | * | 12/1964 | Slayter | 52/411 |
| 3,276,797 | A | * | 10/1966 | Humes | 52/715 |
| 3,305,986 | A | | 2/1967 | Mathews | |
| 3,401,494 | A | * | 9/1968 | Anderson | 52/309.2 |
| 3,928,691 | A | | 12/1975 | Knudson | |
| 3,979,867 | A | * | 9/1976 | Sowinski | 52/309.11 |
| 4,037,377 | A | | 7/1977 | Howell et al. | |
| 4,068,434 | A | | 1/1978 | Day et al. | |
| 4,109,436 | A | * | 8/1978 | Berloty | 52/309.2 |
| 4,154,030 | A | | 5/1979 | Huguet | |
| 4,163,349 | A | | 8/1979 | Smith | |
| 4,223,500 | A | | 9/1980 | Clark et al. | |
| 4,224,774 | A | | 9/1980 | Petersen | |
| 4,267,679 | A | * | 5/1981 | Thompson | 52/588.1 |
| 4,284,447 | A | | 8/1981 | Dickens et al. | |
| 4,330,921 | A | | 5/1982 | White, Jr. | |
| 4,443,988 | A | * | 4/1984 | Coutu, Sr. | 52/309.9 |
| 4,471,591 | A | | 9/1984 | Jamison | |
| 4,475,325 | A | | 10/1984 | Veldhoen | |
| 4,478,018 | A | * | 10/1984 | Holand | 52/220.1 |
| 4,488,390 | A | | 12/1984 | Mulford | |
| 4,602,466 | A | | 7/1986 | Larson | |
| 4,635,413 | A | | 1/1987 | Hansen et al. | |
| 4,641,468 | A | | 2/1987 | Slater | |
| 4,646,502 | A | | 3/1987 | Ziehbrunner | |
| 4,658,557 | A | | 4/1987 | Mulford | |
| 4,671,038 | A | * | 6/1987 | Porter | 52/586.1 |
| 4,674,253 | A | | 6/1987 | Young | |
| 4,702,058 | A | | 10/1987 | Bennett | |
| 4,754,587 | A | | 7/1988 | Glaser | |
| 4,765,105 | A | | 8/1988 | Tissington et al. | |
| 4,774,119 | A | * | 9/1988 | Imhoff | 428/71 |
| 4,813,193 | A | | 3/1989 | Altizer | |
| 4,852,314 | A | | 8/1989 | Moore, Jr. | |
| 4,856,244 | A | | 8/1989 | Clapp | |
| 4,862,660 | A | | 9/1989 | Raymond | |
| 4,965,970 | A | | 10/1990 | Nania | |
| 4,981,003 | A | | 1/1991 | McCarthy | |
| 5,067,296 | A | * | 11/1991 | Brown et al. | 52/309.7 |
| 5,072,569 | A | | 12/1991 | VanTassel | |

(List continued on next page.)

*Primary Examiner*—Carl D. Friedman
*Assistant Examiner*—Kevin McDermott
(74) *Attorney, Agent, or Firm*—Lieberman & Brandsdorfer, LLC

(57) ABSTRACT

A modular wall panel for manufacturing an exterior wall is made from a substantially flat rectangular insulating foam core having two opposite surfaces, two opposite side edges, a width defined by the opposite side edges, opposite top and bottom edges, and a length defined by the top and bottom edges. The panel also has at least one elongated longitudinal support stud and at least one elongated transverse stud, each mounted to the foam core. The first side edge of the panel has a first face extending between the opposite surfaces and the second side edge has a second face extending between the opposite surfaces. Each face defines an elongated first channel when the first face of one panel is abutted against the second face of an adjacent panel and the first channel has an elongated first cavity and an opening extending to the first surface of the panels.

9 Claims, 15 Drawing Sheets

U.S. PATENT DOCUMENTS 5,233,803 A 8/1993 Bockmiller
5,245,809 A 9/1993 Harrington
5,265,389 A * 11/1993 Mazzone et al. ..... 52/309.7
5,269,109 A 12/1993 Gulur
5,279,089 A 1/1994 Gulur
5,285,607 A 2/1994 Somerville
5,297,369 A 3/1994 Dickinson
5,353,560 A 10/1994 Heydon
5,377,470 A * 1/1995 Hebinck ..... 52/405.1
5,381,638 A 1/1995 Andersson
5,410,849 A * 5/1995 Christopher ..... 52/309.2
5,433,050 A 7/1995 Wilson et al.
5,465,541 A 11/1995 Lin et al.
5,497,589 A 3/1996 Porter
5,519,971 A 5/1996 Ramirez
5,765,330 A 6/1998 Richard
5,771,645 A * 6/1998 Porter ..... 52/220.2
5,799,462 A * 9/1998 McKinney ..... 52/742.13
6,044,603 A * 4/2000 Bader ..... 52/309.7
6,131,897 A * 10/2000 Barz et al. ..... 269/207
6,167,624 B1 * 1/2001 Lanahan et al. ..... 29/897.32
6,308,491 B1 * 10/2001 Porter ..... 52/794.1
6,421,972 B1 * 7/2002 Dalphond ..... 52/309.7

* cited by examiner

WALL FRAMING SYSTEM

FIELD OF THE INVENTION

The present invention relates generally to building and building structures and more particularly to wall panels and wall sections and to methods adapted to form wall frames.

BACKGROUND OF THE INVENTION

Insulated building panels for use in constructing walls is well-known in the art. These wall framing panels generally consist of an insulating foam core covered on each side by a sheeting material such as plywood or oriented strand board (OSB). These panels often have reinforcing studs to provide the panel with additional rigidity and strength. Originally, these wall panel constructions were manufactured having plywood or OSB sheathing, surrounding a polyurethane or other foam core and having reinforcing wooden studs vertically aligned within the panel. Over the years, metal framing construction has become increasingly popular and wall panel manufacturers have gradually replaced wooden reinforcing struts with metal reinforcing struts. As a result, many modular wall panels available today use metal framing construction studs as well as expanded polystyrene (EPS) foam.

Modular wall panels are useful in residential and commercial building construction since they make the assembly of wall frames more efficient. Essentially, a wall frame can be built by simply joining a series of preformed wall panels. Unfortunately, a majority of building designs require customized wall panels. Many modular wall panels can be customized to meet almost any building design by simply resizing the panels to fit the design; however, resizing the wall panels is a difficult task that can usually only be performed by the manufacturer. In practice, the builder must take his architectural plans to the wall panel manufacture, who in turn trims and resizes the wall panels to fit the architectural plans.

While this system of modular wall panel construction is more efficient than constructing a building from scratch, it does have limitations. Firstly, since existing modular wall construction panels cannot be customized in the field, the builder must ensure that the architectural drawings are accurate before sending them to the wall panel manufacturer. The builder is also obligated to follow the architectural drawings precisely since the wall panels are constructed to adhere to the original architectural drawings. Furthermore, the wall panel manufacturer must be very careful in interpreting the architectural drawings to ensure accurately built wall panels. A truly modular and universal wall panel construction system could overcome these limitations if the wall panels could easily be modified in the field.

SUMMARY OF THE INVENTION

The present invention overcomes the drawbacks of the prior art by providing a modular wall panel for manufacturing an exterior wall by abutting a plurality of said wall panels in side to side alignment. Each of said wall panels consists of a substantially flat rectangular insulating foam core having first and second opposite surfaces, first and second opposite side edges, a width defined by the opposite side edges, opposite top and bottom edges, and a length defined by the top and bottom edges. The panel also has at least one elongated longitudinal support stud mounted to the foam core between the first and second side edges. The longitudinal stud extends substantially the length of the foam core between the top and bottom edges, and extends parallel to the side edges. The panel also has at least one elongated transverse support stud mounted to the foam core substantially perpendicularly relative to the longitudinal support stud, said transverse support stud extending between the opposite side edges. The first side edge of the panel has a first face extending between the first and second opposite sides and the second side edge having a second face extending between the first and second opposite sides. The first and second faces are adapted and configured such that the first and second faces define an elongated first channel when the first face of one panel is abutted against the second face of an adjacent panel, said first channel having a elongated first cavity and an opening extending to the first surface of the panels.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DETAILED DESCRIPTION OF THE PRESENT INVENTION

The present invention is a modular wall framing system which uses standard wall panel sections which can be easily and securely connected together to form a wall frame. The wall framing sections are easily customizable in the field using ordinary construction equipment such as circular saws, nail guns, and alike. The system consists of a series of preformed, standardized wall panel sections. Each section has vertical and horizontal side edges which are adapted and configured to permit adjacent wall panels to be mounted together very simply, while maintaining a weather proof and rigid construction. The wall panels are also designed to be easily resized to the particular needs of the builder. Hence, a builder wishing to construct a wall frame can simply purchase all of the component wall panel sections and then assemble and customize them in the field.

Figure 1:
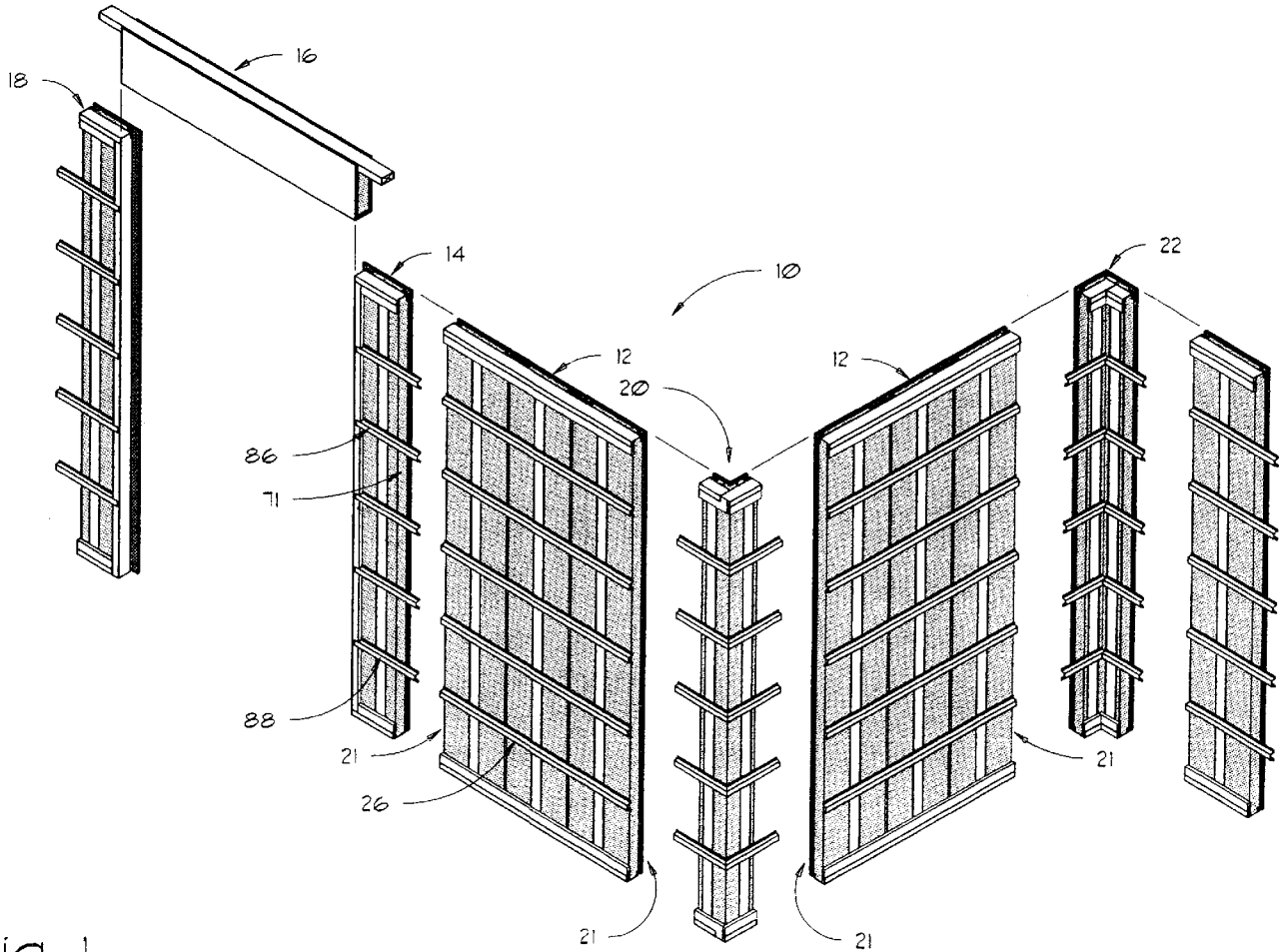
FIG. 1 is an exploded view of a portion of a wall construction made in accordance with the present invention.
Figure 2:
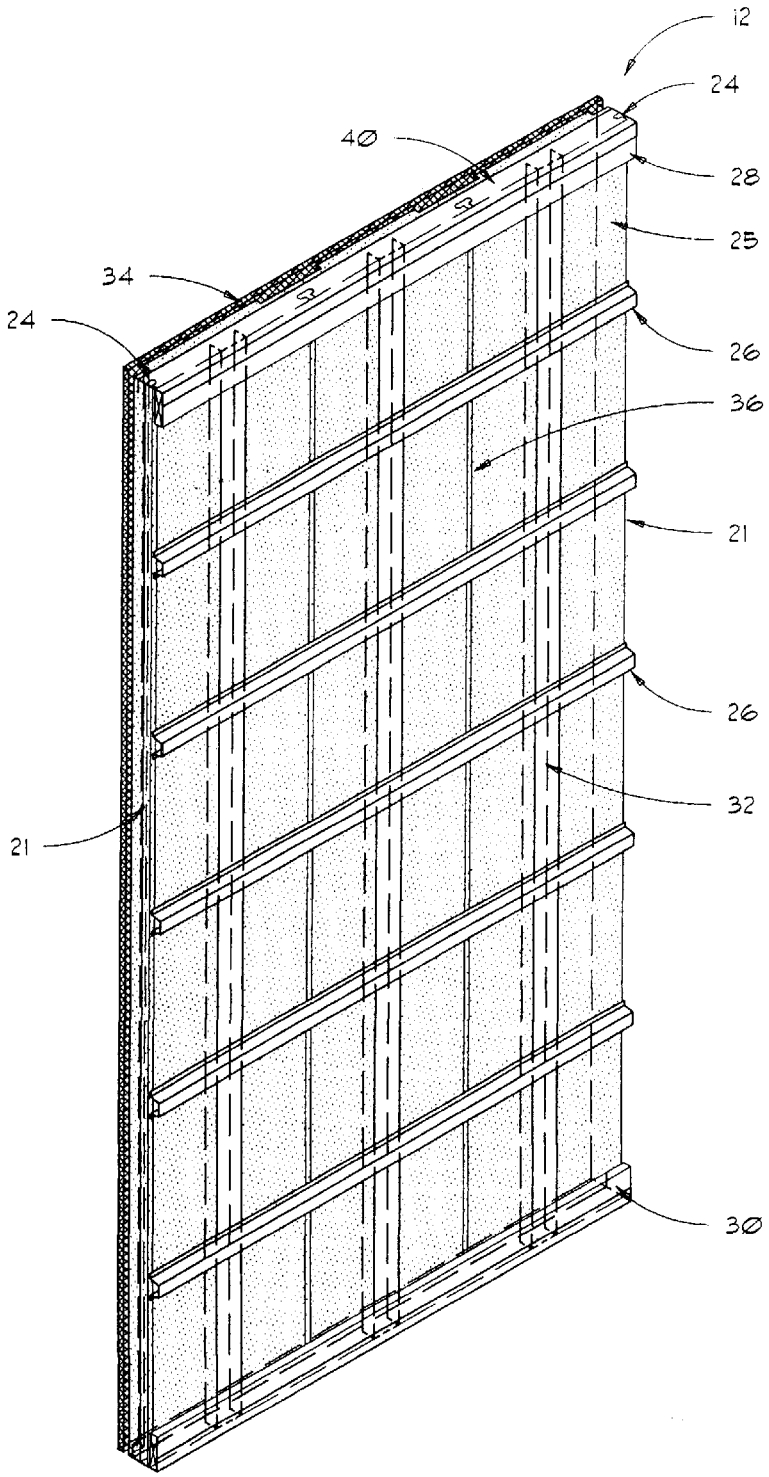
FIG. 2 is a prospective view of a modular wall panel made in accordance with the present invention.

Referring firstly to FIG. 1, a wall framing system made in accordance with the present invention is shown generally as item 10 and is composed of the following modular wall frame sections namely, wall panel 12, right jack and trimmer panel (JT Panel) 14, header module 16, left JT Panel 18, inside corner section 20 and outside corner section 22. Each of these panel sections (excepting the modular header) have very similar construction. For example, as seen in FIG. 2, wall panel 12 consists of a foam core panel 25, having edge face 21, vertical metal studs 32, rigid sheathing 34, horizontal metal furring 26, top nailing strip 28, bottom nailing strip 30, vertical foam channel 36 and side foam channels 24. Vertical metal studs 32 and horizontal metal furring 26 provide structural strength to the panel. Nailing strips 28 and 30 permit interior drywall or panelling to be attached to the inside surface of the wall panel after the wall is constructed. Top nailing strip 28 also acts as a gusset plate to help distribute the weight of the floor or roof above.

Figure 3:
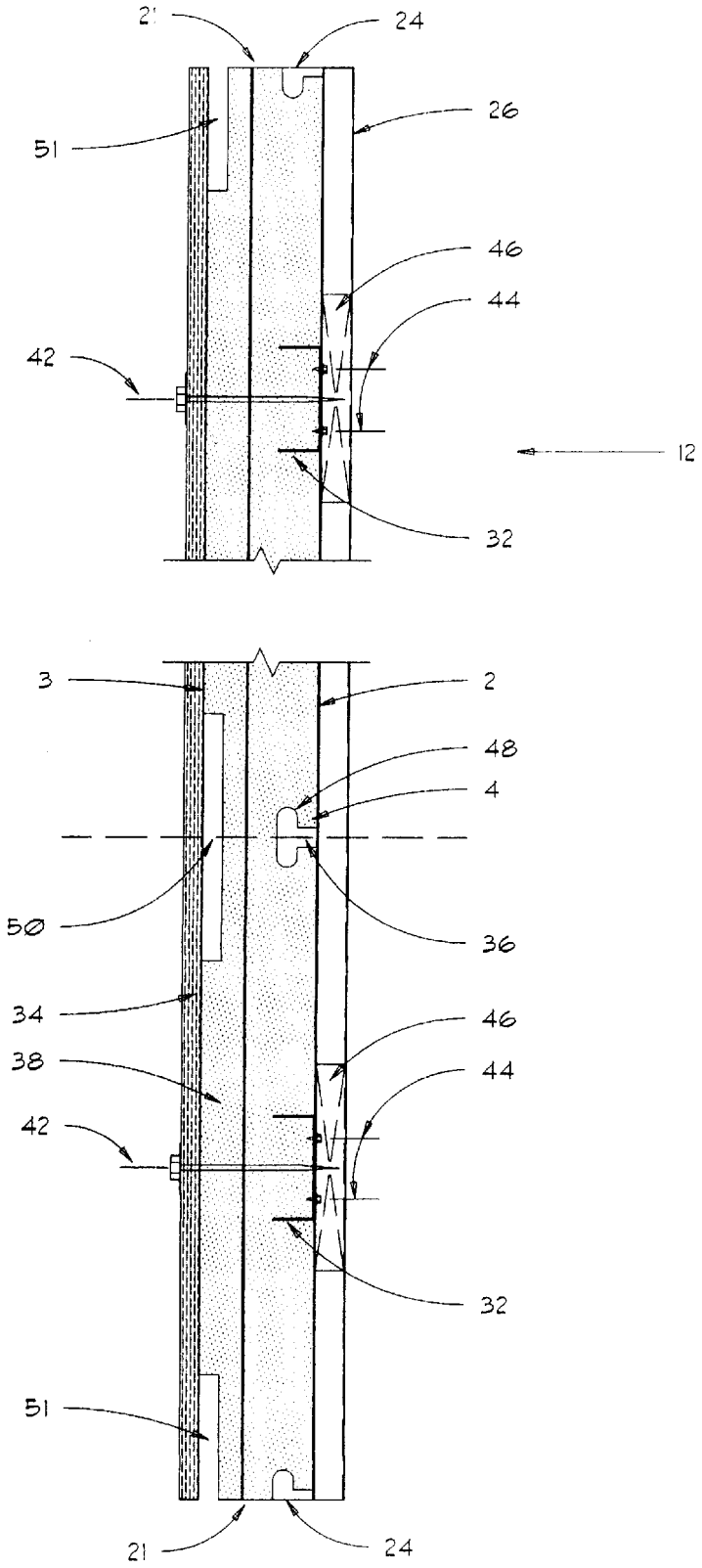
FIG. 3 is a cross sectional view of a wall panel made in accordance with the present invention.

Referring now to FIG. 3, foam core 25 consists of a substantially rectangular foam slab having inside surface 2, outside surface 3 and side edge faces 21. Foam core 25 may be made of any commercially available rigid foam insulation material such as expanded polystyrene (EPS). In particular, foam core 25 may consist of standard sized EPS panel 38 having a thickness of about 2¾ inches. While foam core 25 may be made in any size or thickness, for many practical applications the foam core will consist of a sheet about four feet wide and eight feet high and having a thickness of approximately 2¾ inches. Standard EPS panels used to construct foam core 25 are available in sizes ranging from 4'×8' to 4'×24', so many different dimensions may be used depending on local business codes and the needs of the builder. For example, three foam panels measuring 4'×8' may be used to make one larger wall panel. Depending on the thickness and type of foam used, foam core 25 may have considerable insulating capacity (generally EPS panels have an R4 rating per inch of thickness, therefore a 2¾ inch thick panel will have an R rating of approximately 11).

Sheathing 34 may comprise any weather resistant, commercially available structural sheathing used in residential construction, such as plywood, oriented strand board (OSB) or even exterior drywall sheathing. Alternatively, sheathing 34 may comprise a thick weather resistant coating applied directly onto foam core 25. Generally speaking, if used to make standard sized wall panels 12, sheathing 34 will have typical dimensions of approximately by 4'×8'×½". Sheathing 34 is secured to foam core 25 by screws 42 or by other methods known generally in the art such as gluing or bonding. To provide wall panel 12 with additional strength, vertical metal studs 32 are provided. Metal studs 32 consist of sheet metal strips which have "U-shape" profiles. The gauge of the sheet metal used and the dimensions of the metal stud are selected to meet the desired load characteristics of the wall. Foam core 25 is pre-scored to accept metal studs 32. To provide the wall panel with additional strength, metal furring channels 26 are mounted to foam core 25 such that the furring channels extend horizontally along the wall panel. Furring channels 26 and vertical studs 32 may be held rigidly in place by elongated screws 42 which pass through sheathing 34. Furring channels 26 may contain small wooden cores 46 strategically placed to engage screws 42. Furring channels 26 may also be rigidly mounted to vertical studs 32 by short screws 44. Alternatively, other methods of securing studs 32 and furring channels 26 may be used, including staples, screws, nails or glue.

Figure 10:
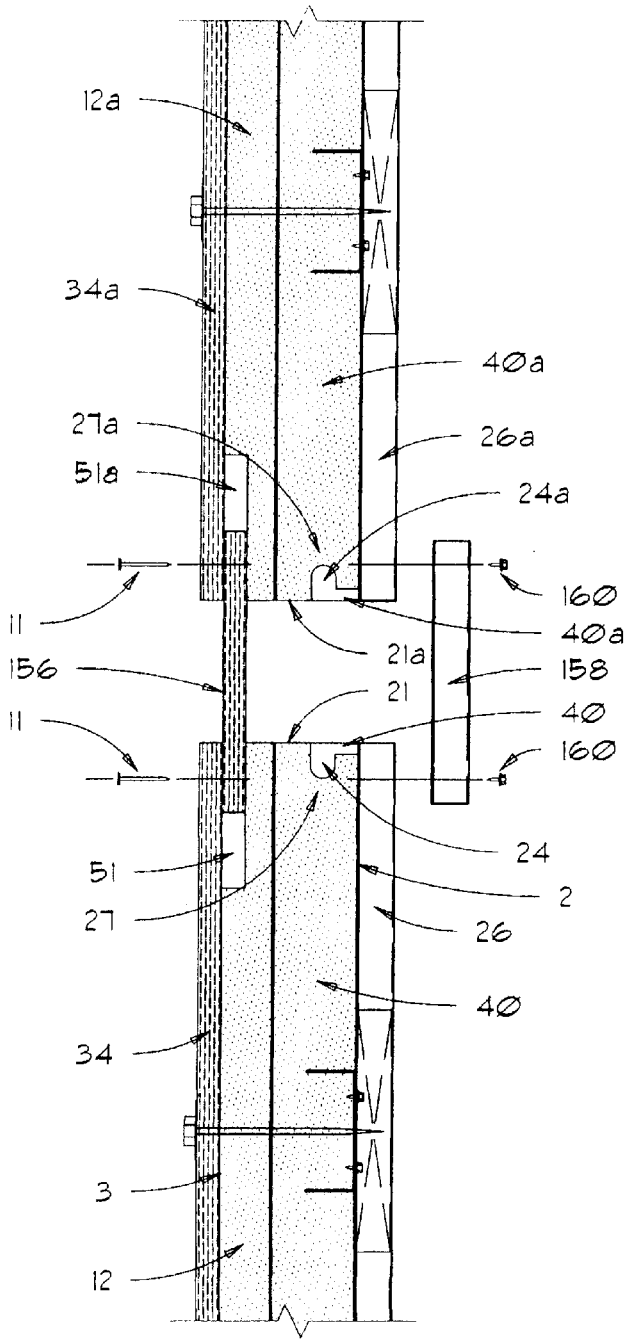
FIG. 10 is a cross-sectional view of a typical joint between two modular wall sections made in accordance with the present invention.

As best seen in FIGS. 3 and 10, side edge faces 21 of foam core 25 are dimensioned and configured such that two opposing edge faces 21 of adjacent panels 12 can abut together to form a foam joint channel 24 between the edge faces 21, each edge face forming one half of the foam joint channel. Each half of foam joints 24 consist of elongated groove 27 which is formed on edge face 21 and extends the entire length of foam core 25 between the top and bottom edges of the foam core. A foam joint is formed between abutting wall panels 12 when edge face 21 of one panel is abutted against the corresponding edge face of the abutting wall panel. The foam joint channel formed by abutting edge faces 21 will form an elongated channel formed by grooves 27 which is open to inside surface 2 of foam core 25. The formation of an actual joint between two abutting wall panels will be discussed later on.

Referring back to FIG. 3, foam core 25 also has channel 4 extending longitudinally along the entire length of the foam core between the top and bottom edges of the core (not shown). Channel 4 is formed on inside surface 2 of foam core 25 between the side edges of the foam core. Channel 4 is formed from elongated groove 48 which is open to inside surface 2 by elongated slot 36. Channel 4 is preferably dimensioned and configured to receive house hold wiring and plumbing. Spline cavities 50 and 51 are also formed in foam core 25. Spline cavity 50 is formed on outside surface 3 of foam core 25 and extends vertically along the entire length of the panel from the top to bottom edges. Spline cavity 50 is positioned adjacent channel 4 and extends parallel to channel 4. Preferably, spline cavity 50 is positioned between channel 4 and sheeting 34. Spline cavity 50 and channel 4 are dimensioned and configured such that when panel 12 is cut along line 9, cavity 50 and channel 4 are bisected leaving two smaller panel sections having side edge faces, each side edge face having a portion of cavity 50, groove 48 and slot 36. Spline cavities 51 are formed on edge faces 21 as elongated grooves extending parallel and adjacent to grooves 27. Spline cavities 51 are formed between grooves 27 and sheet 34. As will be discussed later, Spline cavities 51 assist in the joining of adjacent wall panels.

Figure 4:
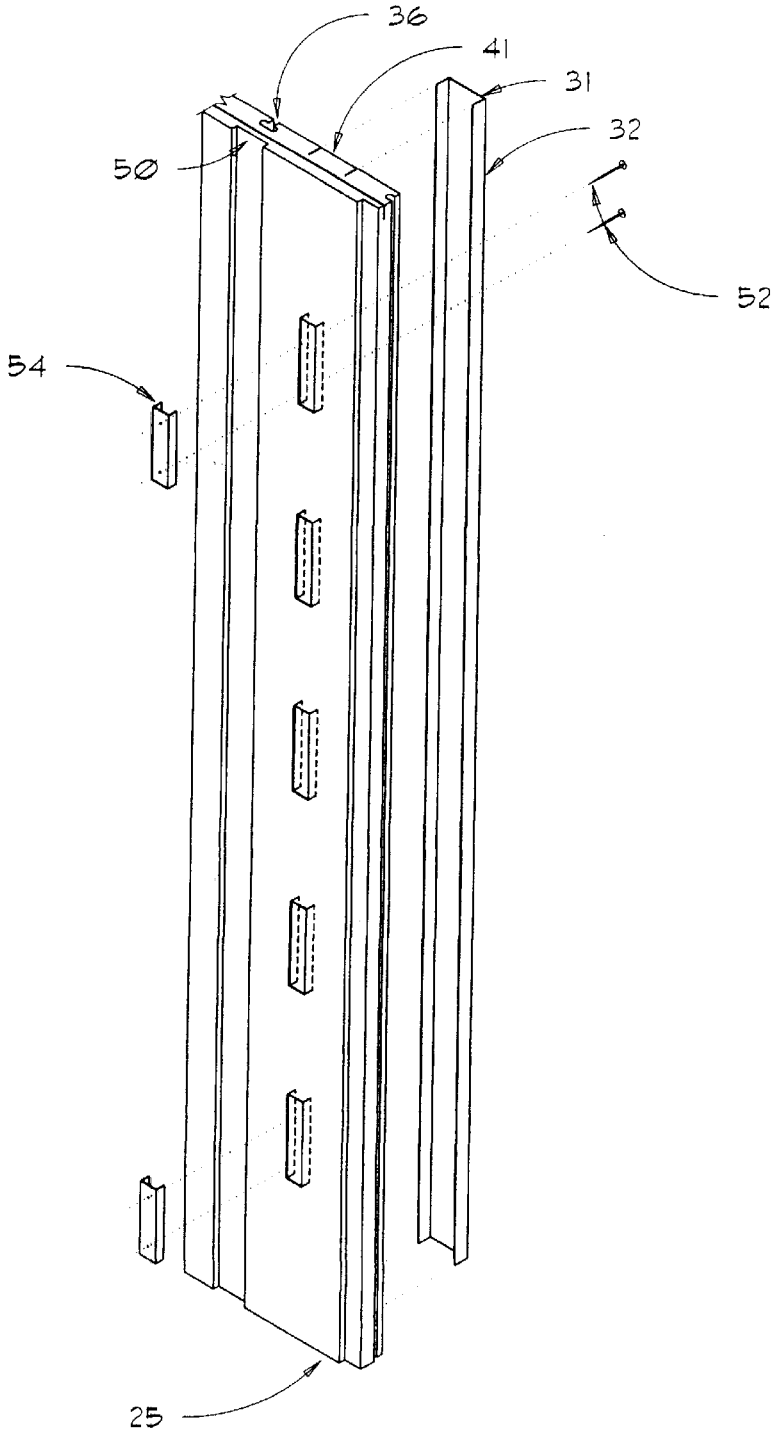
FIG. 4 is a prospective view of a portion of a wall panel made in accordance with the present invention.

Referring now to FIG. 4, an alternate method of mounting vertical stud 32 to foam core 25 will be discussed. Foam core 35 may be provided with a plurality of brackets 54 which are vertically oriented along the length of the foam core. Brackets 54 permit the vertical stud 32 to be mounted to the foam core via screws 52. Foam core 25 should have vertically oriented slits 41 which are configured to receive legs 31 of vertical stud 32.

Figure 15:
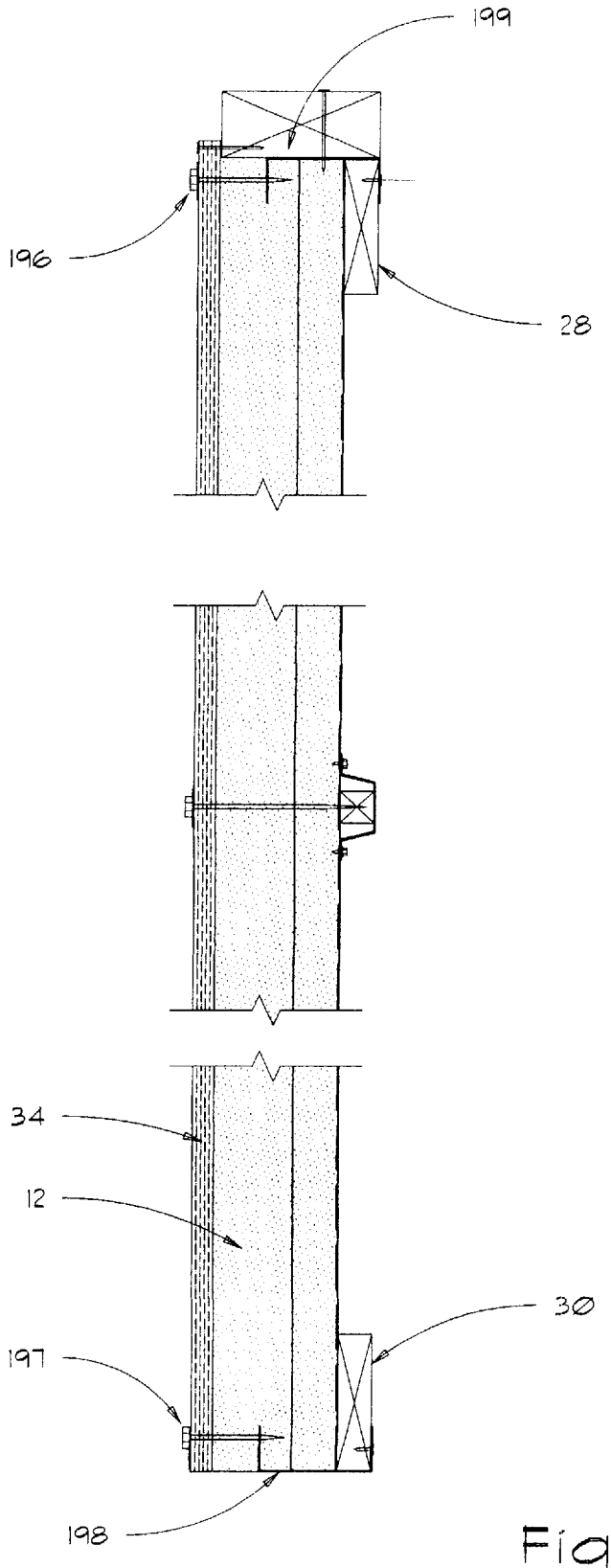
FIG. 15 is an exploded perspective view showing a wall segment being assembled by wall panels of different size.

Referring now to FIG. 15, the bottom and top of each of the panels is provided with a metal stud which adds structural strength. Bottom metal stud 198 of panel 12 is preferably made of a U shaped piece of metal which is secured to sheet 34 via attachment element 197. Attachment 197 may comprise a screw or nail. Preferably metal stud 198 is spaced some distance away from sheet 34 to permit an insulation gap. Metal stud 199 is secured to the top of panel 12 via mounting element 196. Stud 199 is spaced away from sheet 34 to permit an insulation gap. Mounting element 196 can comprise a screw or nail. Cap 199 and 198 help secure nailing strips 28 and 30, respectively, and also provide structural strength.

Figure 5:
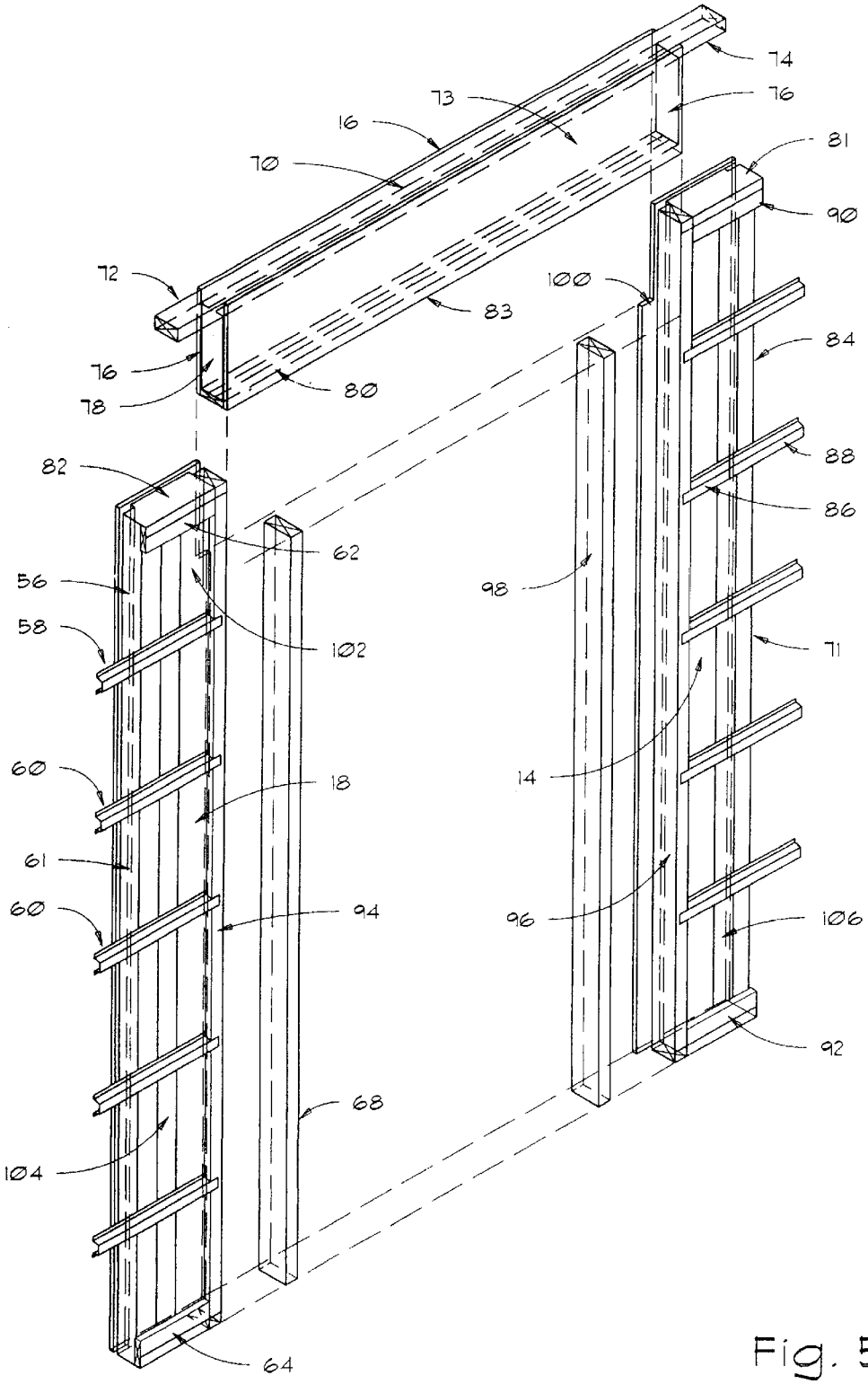
FIG. 5 is an exploded view of a wall frame door opening made in accordance with the present invention.

Referring now to FIG. 5, a door or window opening in the wall construction can be easily manufactured using the present system from standard components, regardless of the dimensions of the opening. An appropriate opening can be manufactured using right JT panel 14, left JT panel 18, and header section 16. Right and left JT panels 14 and 18, respectively, are manufactured from wall sections 84 and 56, respectively, which are nearly identical in construction to wall panel 12 as previously discussed. Right JT Panel 14 has a vertical wall stud 106, a bottom nailing strip 92, furring channels 86, top cap 81 and edge stud 96. Furring channels 86 have extensions 88 which extend beyond right edge face 71. Likewise left LT panel 18 has furring channels 58 with extensions 60, vertical metal wall studs 104, bottom nailing strip 64, top nailing strip 62, top cap 82, left side edge face 61, vertical stud 94, and wall section 56. Left side edge face 61 of left LT Panel 18 and right edge face 71 of right JT Panel 14 are identical to edge faces 21 of panel 12, as previously discussed.

Figure 13:
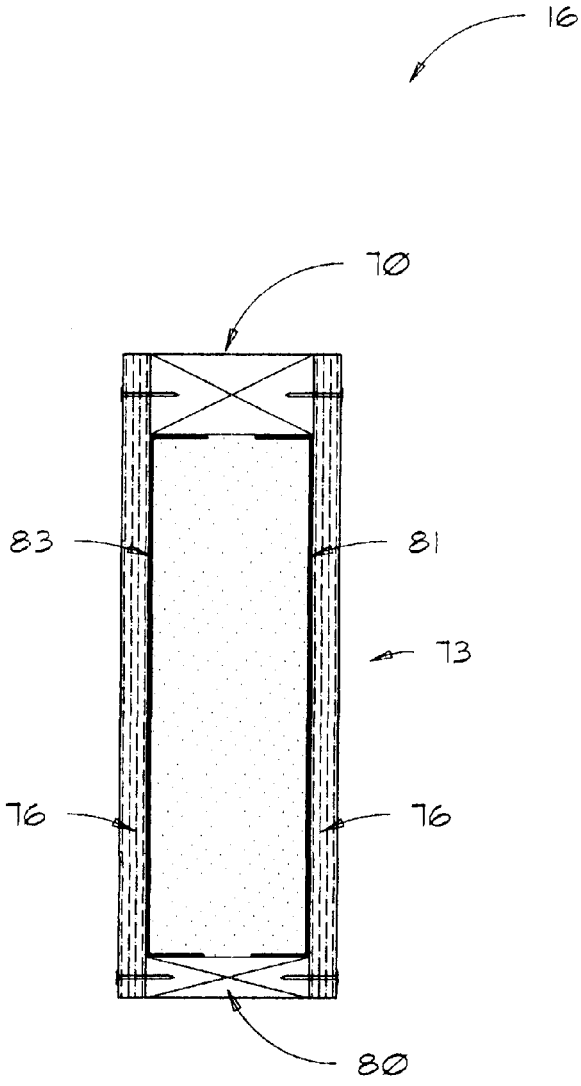
FIG. 13 is a cross sectional view of a header panel portion made in accordance with the present invention.

Right JT panel 14 has extension 100, which is an extension of the sheathing material of wall 84. Likewise, Left JT panel 18 has an extension 102, which is likewise an extension of the sheathing of wall 56. Extensions 100 and 102 of JT panels 14 and 18, respectively, are configured to receive header section 16. Header section 16 consists of wooden stud 70 having ends 72 and 74, which is mounted to a lower wall segment 73. Lower wall segment 73 consists of a foam core 78 mounted between sheets 76. Sheets 76 may consist of OSB, plywood, or exterior drywall. A lower wooden stud 80 is mounted to bottom end 83 of wall segment 73. Studs 70 and 80 may be mounted to sheets 76, by nails, adhesive, or other methods known in the art. Stud 70 is longer than bottom portion 73 so that ends 72 and 74 project outside of bottom wall section 73. As better seen in FIG. 13, foam core 78 is mounted between metal brackets 81 and 83. Metal brackets 81 and 83 have U shaped profiles, and give header 16 additional structural strength.

Referring back to FIG. 5, header section 16 is mounted to the top of JT sections 14 and 18 by nailing ends 72 and 74 of stud 70 to top caps 82 and 81, respectively. Extensions 100 and 102 of JT sections 14 and 18, respectively, are configured to receive wall section 73 of header section 16. Likewise, wooden studs 68 and 98 are cut to length so as to receive wall section 73 of header section 16 and thereby stud 80 when the header section is installed. Header section 16 may be cut to size by simply removing stud 70 and then cutting wall section 73 as desired. Hence any size door opening may be framed simply by cutting header section 16 to the desired length. Wooden studs 68 and 98 may be attached to studs 94 and 96 of left and right JT sections 18 and 14, respectively, and, together with stud 80, form a door or window jam.

Figure 6:
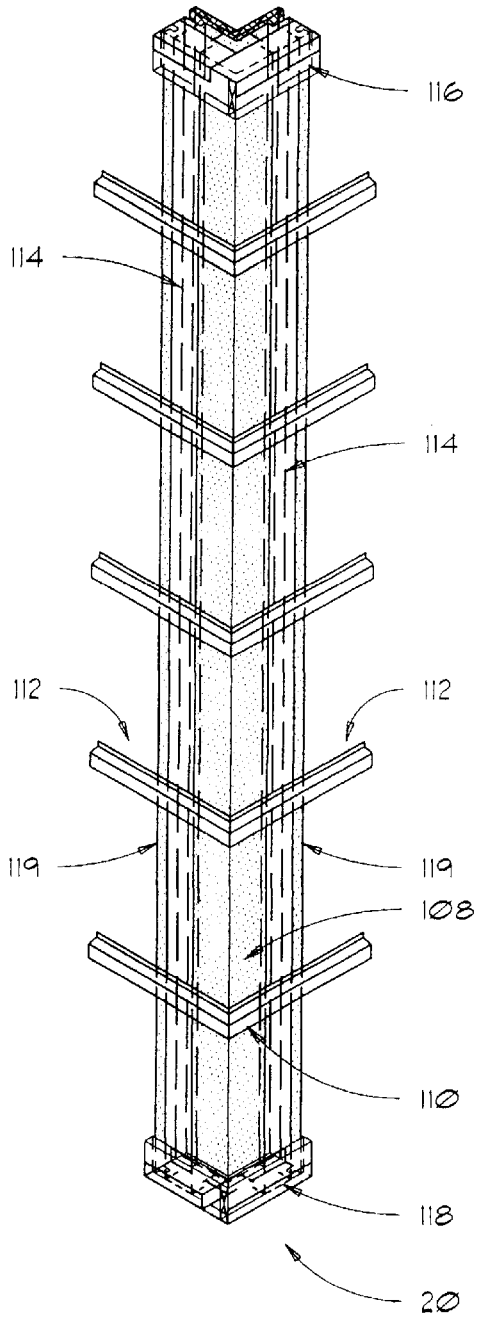
FIG. 6 is a perspective view of a modular inside corner wall section, made in accordance with the present invention.

Referring now to FIG. 6, inside corner panel section 20 consists of a wall panel section 108 having horizontal furring channels 110, vertical metal studs 114 and side edge faces 119. Furring channels 110 extend beyond edge faces 119 of panel section 108 to form elongated caps 112. Panel section 108 is triangular in shape and is used to form an inside corner section of a wall construction. Panel section 20 has bottom nailing strip 118 and top nailing strip 116, both of which may be made of wood and permit easy attachment of crown mouldings and baseboards in the finished wall construction. Side edge faces 119 of corner panel section 20 is identical to side edge face 21 of panel 12 as previously discussed.

Figure 7:
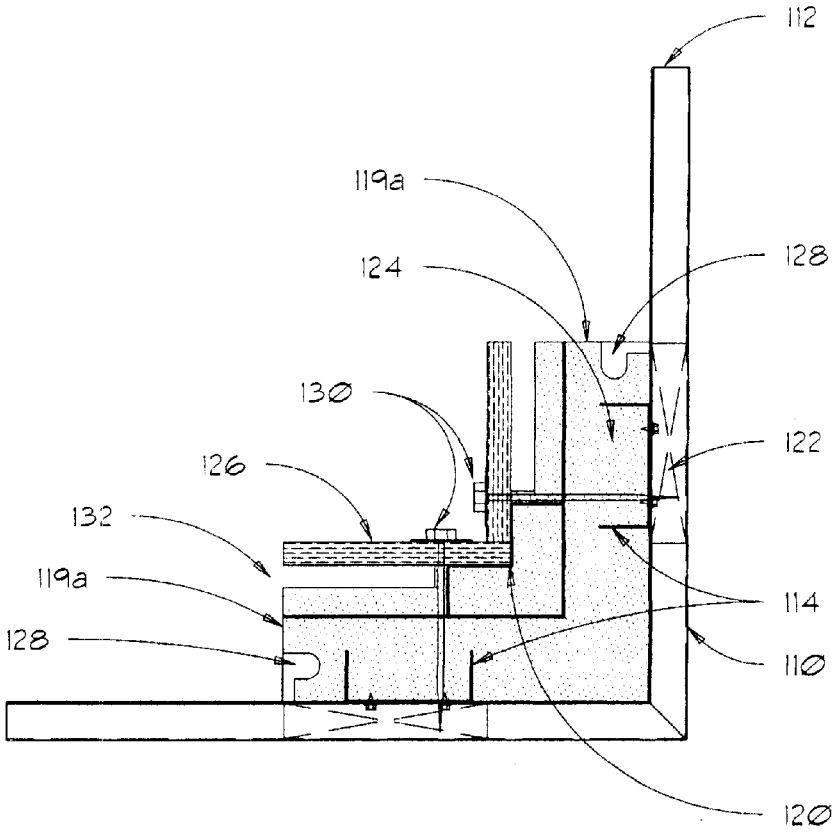
FIG. 7 is a cross-sectional view of a modular inside corner wall panel section made in accordance with the present invention.

Referring now to FIG. 7, wall panel 108 is substantially identical to the construction of the other wall panels and consists of a foam core 124, sheathing 126, vertical metal studs 114 and side edge faces 119*a*. Horizontal metal furring channels 110 are mounted to foam core 124 via elongated screws 130 which pass through both sheathing material 126 and vertical studs 114. An inside corner vertical metal stud 120 is also provided to add additional vertical strength to the corner panel. Side edge faces 119*a* are provided with spline cavities 132 as well as foam joints 128 and are otherwise identical to the side edge faces of the other panel sections. Furring channels 110 extend beyond edges 119 to form hat channels 112 which are useful in joining one panel to another as will be discussed later.

Figure 8:
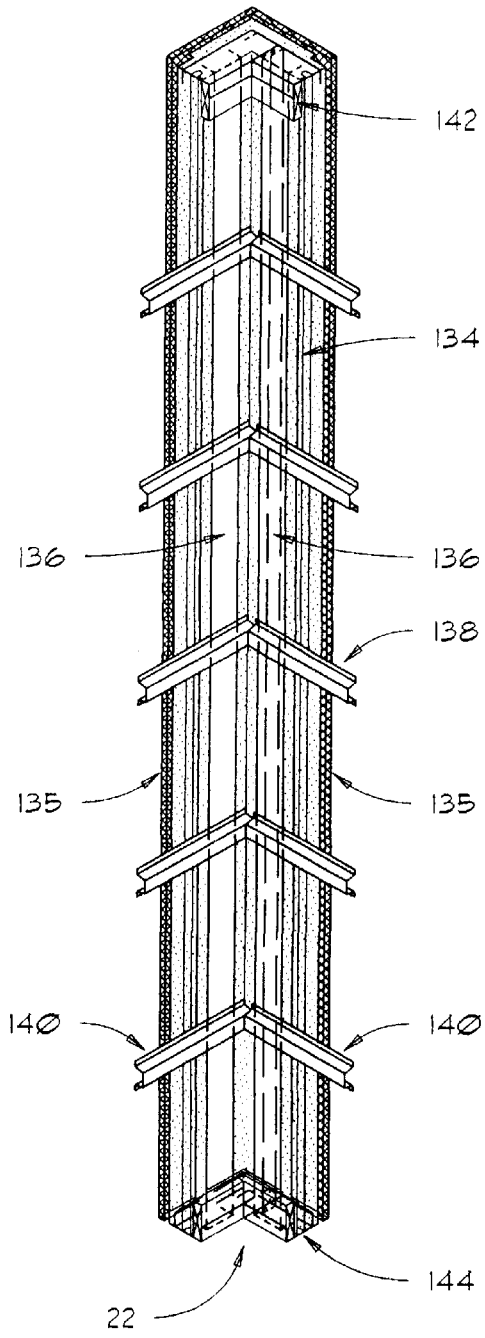
FIG. 8 is a perspective view of an outside modular wall corner section made in accordance with the present invention.

Referring now to FIG. 8, outside corner panel section 22 consists of a corner shaped wall panel section 134 having side edge faces 135, horizontal metal furring 138, bottom nailing strip 144 and top nailing strip 142. Horizontal metal furring channels 138 have extensions 140 which extend beyond edge 135. Side edge faces 135 are identical to the side edge faces of the other wall panels as previously discussed.

Figure 9:
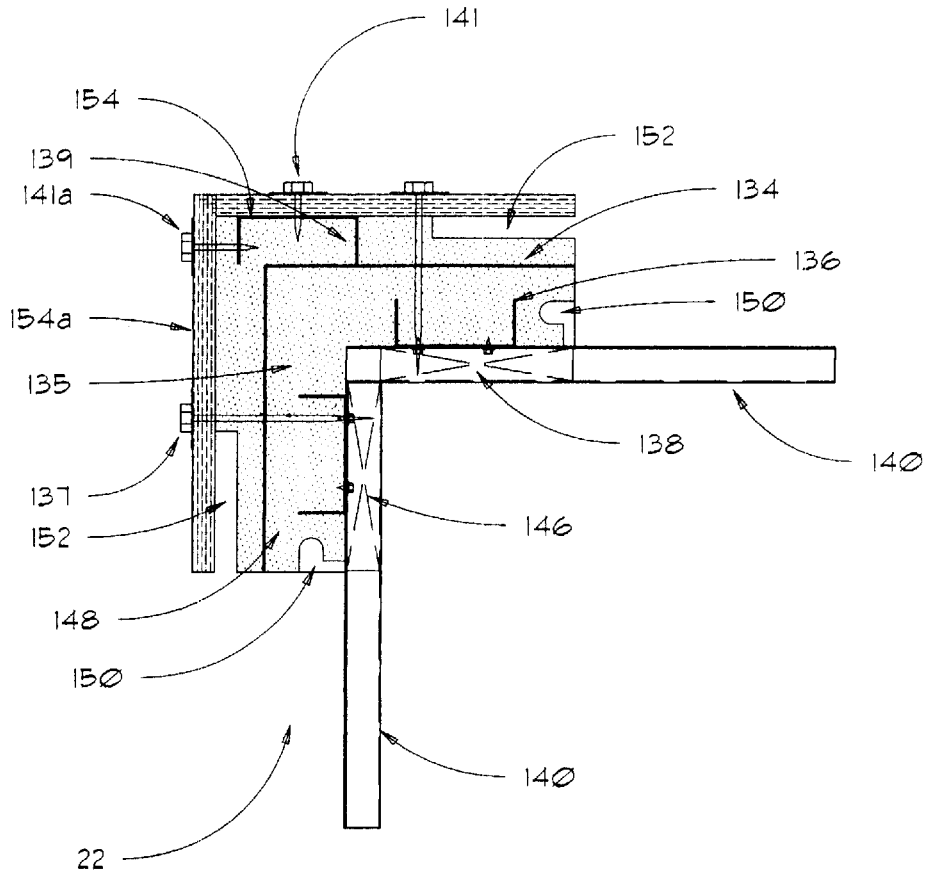
FIG. 9 is a cross-sectional view of an outside modular corner panel section made in accordance with the present invention.

Referring now to FIG. 9, panel 134 consists of a foam core 135 mounted to a corner shaped piece of sheathing 154. Foam core 135 has spline cavities 152 and foam joint cavities 150. Vertical studs 136 are mounted to foam core 148 via elongated screws. Wooden segments 146 may be present within furring channels 138 to permit easier attachment of elongated screws 137. To provide the corner panel with additional strength, an additional vertical metal stud 139 may be mounted directly to sheathing 154 via screws 141.

The component parts of the wall construction having thus been explained, the assembly of the various segments into a suitable wall frame will now be discussed with reference to FIGS. 1 and 10. As seen in FIG. 1, the various wall panel sections are configured such that the sections can be joined together along their respective edges. Hence panel 12 may be attached to Panel 14 simply by bringing side edge face 21 of panel 12 into contact with side edge face 71 of panel 14. Furring channels 26 of panel 12 are positioned in line with furring channels 86 of panel 14 such that when edge faces 21 and 71 are brought together, extensions 88 overlap on top of furring channels 26. Extensions 88 may be rigidly mounted to furring channels 26 where they overlap by simply driving screws through extensions 86 and into furring 26, thereby creating a rigid attachment between panels 12 and 14. Likewise, panel 12 may be attached to panel 20 in an identical fashion as to panel 14. If a wall section is particularly long, multiple panel 12*s* can be attached in abutting end to end fashion.

Referring now to FIG. 10, the joint between any two panels can be further secured by the use of a spline and chase joint. For example, if two panels 12 and 12*a* are to be joined, side edge faces 21 and 21*a* of the two panels are brought into contact. A spline segment 156 is inserted into spline cavities 51 and 51*a* of panels 12 and 12*a* and secured by nails 11. Spline segment 156 is preferably made of the same material as sheathing 34 and 34*a*. Preferably the diameter of spline segment 156 is dimensioned such that it is completely contained within cavities 51 and 51*a* when end faces 21 and 21*a* make physical contact. To add additional strength to the joint, a hat channel 158 can be mounted on top of furring 26 and 26*a* and secured thereto by screws 160. The combination of spline 156 and hat channel 158 gives the joint considerable strength.

In order to ensure that there is good weather sealing between the two panels, elongated foam channel joints 24 and 24*a* form a recessed foam channel when end faces 21 and 21*a* are abutted together. The elongated channel joint 24 is formed by grooves 27 and 27*a*. Grooves 27 and 27*a* have edges 40 and 40*a*, respectively, which extend to inside surface 2 of the foam core. Therefore, when edge faces 21 and 21*a* are abutted together, grooves 27 and 27*a* form an elongated foam channel joint 24/24*a* which is opened to inside surface 2 by an elongated slot like opening formed by edges 40 and 40*a*. An insulating aerosol foam may then be injected through the opening formed by edges 40 and 40*a* and into the channel formed by grooves 27 and 27*a* to create a weather tight seal between the two panels. It will be appreciated that this joint can be formed between any two panel sections.

Referring now to FIG. 3, in the event a panel 12 has to be adjusted in length to make it either shorter or longer, the panel may be cut along line 9, such that foam channel 50 and grooves 48 and 36 are divided in half. With panel 12 cut in this fashion, the panel can be divided into two smaller panel sections, each panel section having a cut end with a portion of channel 50 and a portion of grooves 48 and 36. The net result are two smaller panel sections, each panel section having a cut edge face with an identical structure to edge faces 21. This permits the cut panel section to be mounted to any other modular panel. Furthermore, if the panel needs to be lengthened by a few inches or more, a suitable segment of OSB or some other material may be inserted into the divided sections of channel 50 and a segment of furring tube can be attached onto furring channel 26, in order to form a rigid structure. A segment of EPS foam may then be inserted into the joint and additional foam may then be injected to form a weather tight seal.

Figure 11:
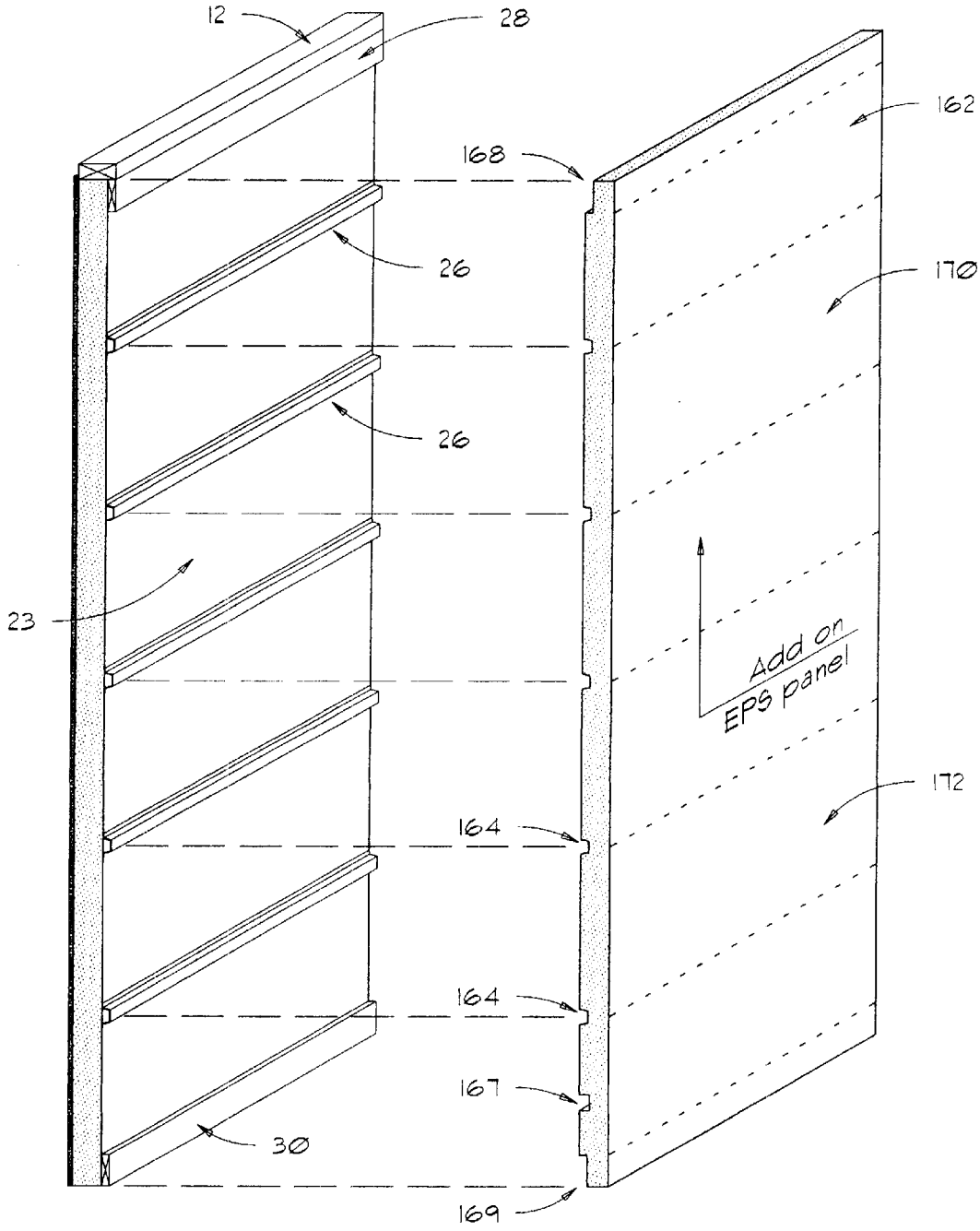
FIG. 11 is a perspective view of an alternative wall panel made in accordance with the present invention.
Figure 12:
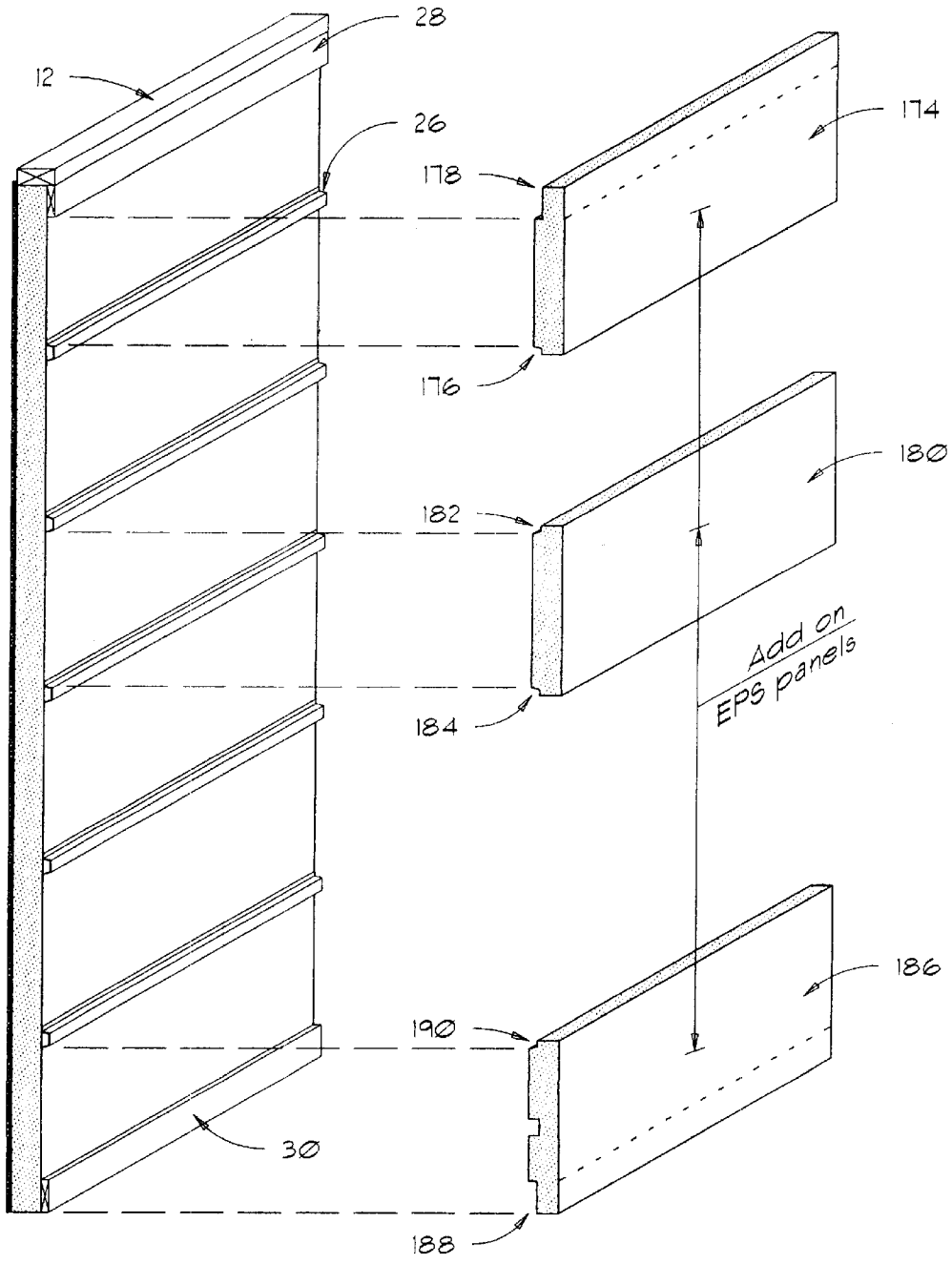
FIG. 12 is a perspective view of yet another alternative embodiment of a wall panel made in accordance with the present invention.

Referring now to FIG. 11, an alternate embodiment of panel 12 will now be disclosed. If a wall panel 12 is to be finished after a wall construction has been made, the wall may be finished by simply attaching a secondary wall panel 162 onto wall panel 12. Panel 162 may be made of an expanded polystyrene or other insulating foam which provides additional insulation value to the wall. Panel 162 has an inward facing surface 170 which may be finished with a drywall stucco or other suitable material. Panel 162 also has an outside surface 172 which is configured to mount onto surface 23 of panel 12. Surface 172 of panel 162 has a plurality of channels 164 which run horizontally along the panel and are configured and dimensioned to receive horizontal furring channels 26. Panel 162 is also provided with top channel 168 and bottom channel 169 which are configured to receive top nailing strip 28 and bottom nailing strip 30 of panel 12, respectively. Panel 162 may also be provided with channel 167 which permits electrical wiring to pass between panels 162 and 12. Alternatively, as seen in FIG. 12, panel 12 may be finished by adding a plurality of insulating panels, 174, 180 and 186. Panel 174 has channels 178 and 176, which are configured to retain top nailing strip 28 and a portion of adjacent furring channel 26. Panel 180 has top channel 182 and bottom channel 184 which are also configured to receive furring channels 26. Bottom panel 186 has channels 190 and 188 which are configured to retain furring channel 26 and bottom nailing strip 30, respectively. Panels 174, 180 and 186 may be made of an insulating foam such as EPS and may be bounded to panel 12 by adhesives or other methods known in the art. Panels 174, 180 and 186 may come in standard lengths of eight feet.

Figure 14:
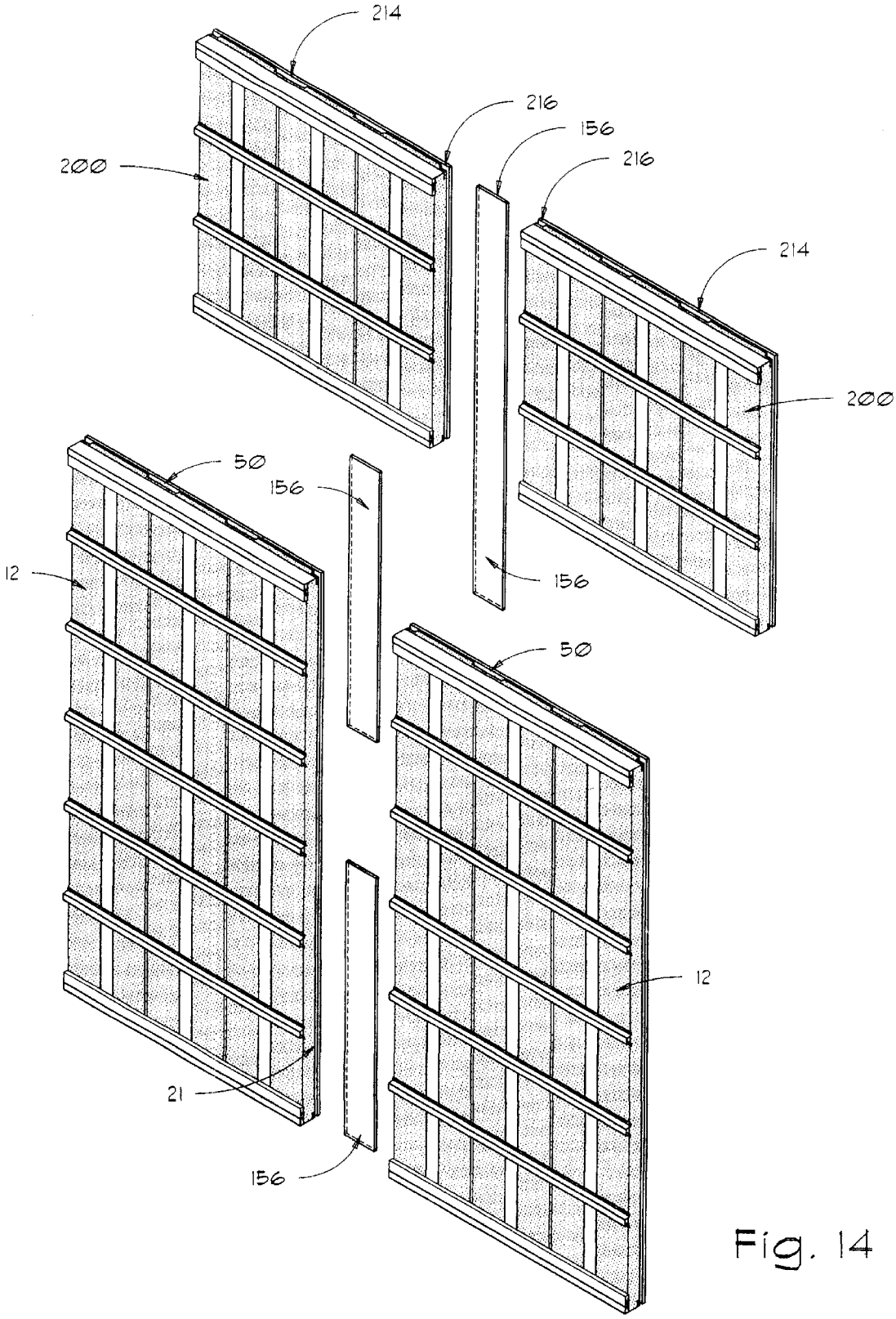
FIG. 14 is a cross sectional view of items 16 shown in FIG. 1.

Referring now to FIG. 14, if a user wishes to build walls which are considerably taller than panels 12, additional panel sections can be stacked one on top of the other using spline sections 156. As seen in FIG. 14, smaller panel sections 200 may be stacked on top of panels 12 if a wall of intermediary height is required. In this arrangement, spline segments 156 are used to add structural rigidity. Panels 200 are identical to panels 12, the only difference being that panels 200 are shorter. For example, panels 12 generally have a height of approximately 8 ft, whereas panel 200 may have a height of only 4 ft. Panels 200 are provided with side edges 212 which are identical to side edges 21 of panels 12. Panels 200 also have spline cavities 214 which are identical to spline cavities 50 of panels 12. Panels 200 and 12 can be staggered one on top of the other such that the spline segments 156 which are used to join panels 12 together at edges 21 are also inserted into spline cavities 214 in panels 200. Likewise the spline segments 156 which are used to join panels 200 together at edges 212 may also be inserted into spline cavities 50 of panels 12. By this staggered arrangements of spline cavities and spline segments, a more rigid construction is formed.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

What is claimed is:

1. A modular wall panel for manufacturing an exterior wall by abutting a plurality of said wall panels in side to side alignment, each of said wall panels comprising:

(a) a substantially flat rectangular insulating foam core having first and second opposite surfaces, first and second opposite side edges, a width defined by the opposite side edges, opposite top and bottom edges, and a height defined by the top and bottom edges;

(b) at least one elongated longitudinal support stud mounted to the foam core between the first and second side edges and extending substantially parallel thereto, said longitudinal support stud extending substantially the length of the foam core between the top and bottom edges;

(c) at least one elongated transverse support stud mounted to the foam core, said transverse support stud mounted substantially perpendicularly relative to the longitudinal support stud, said transverse support stud extending between the opposite side edges;

(d) the first side edge having a first face extending between the first and second opposite surfaces, the second side edge having a second face extending between the first and second opposite surfaces, the first and second faces adapted and configured such that the first and second faces define an elongated first channel when the first face of one panel is abutted against the second face of an adjacent panel, said first channel having an elongated first cavity and an opening extending to the first surface of the panel.

2. The modular wall panel as defined in claim 1; wherein the first face defines an elongated first groove extending substantially the length of the first face, said first groove forming at least a part of the channel.

3. The modular wall panel as defined in claim 2; wherein the second face defines an elongated second groove extending substantially the length of the second face, the first groove of the first face of one panel and the second groove of the second face of an adjoining panel forming the channel when the two panels are abutted together.

4. A modular wall panel as defined in claim 1 further comprising a second elongated channel formed in the foam core, the second channel extending between the top and bottom edges and extending parallel to the side edges, the second channel being open to the first surface by an elongated slot, the channel and slot dimensioned and configured such that the foam core is adapted to be cut longitudinally along the slot to form two smaller panel sections with each panel section having a cut edge with a segment of the second channel and slot extending along said cut edge.

5. The modular wall panel as defined in claim 4; wherein the second channel and slot are dimensioned and configured to receive and retain wiring and plumbing.

6. The modular wall panel as defined in claim 1; further comprising a rigid rectangular sheet mounted to the second surface of the foam core, said rigid sheet having a top and a bottom edge, a length defined by the top and bottom edges, a first and second side edge, a width defined by the side edges, the length and width of the sheet being substantially the same as the length and width of the foam core, the side edges of the sheet being substantially adjacent to the side edges of the foam core, the side edges of the foam core configured such that there is a gap separating the side edges of the foam core and the adjacent side edges of the rigid sheet.

7. The modular wall panel as defined in claim 6; further comprising a second elongated channel formed in the foam core, the second channel extending between the top and bottom edges and extending parallel to the side edges, the second channel being open to the first surface by an elongated slot, the channel and slot dimensioned and configured such that the foam core is adapted to be cut longitudinally along the slot to form two smaller panel sections with each panel section having a cut edge with a segment of the second channel and slot extending along said cut edge, the gap and the slot segment extending along said cut edge.

8. The modular wall panel as defined in claim 7; further comprising an elongated third channel formed on the second surface of the foam core and positioned between the foam core and the sheet, the third channel extending parallel to the second channel and positioned between the second channel and the sheet, said third channel dimensioned and configured such that the panel is adapted to be cut longitudinally along the slot to form two smaller panel sections with each panel section having a cut edge with a segment of the second channel, third channel and slot extending along said cut edge.

9. The wall panel as defined in claim 1; wherein the transverse members comprise an elongated metal furring channel, said furring channel having a substantially U-shaped profile.

* * * * *